US005644319A

United States Patent [19]

Chen et al.

[11] Patent Number: 5,644,319

[45] Date of Patent: Jul. 1, 1997

[54] MULTI-RESONANCE HORIZONTAL-U SHAPED ANTENNA

[75] Inventors: Yung Jinn Chen, Chi Shan; Hsueh-Jyh Li, Taipei; Ruey-Beei Wu, Taipei; Dou-Ken Lee, Taipei, all of Taiwan

[73] Assignee: Industrial Technology Research Institute, Chutung, Taiwan

[21] Appl. No.: 455,916

[22] Filed: May 31, 1995

[51] Int. Cl.[6] ..... H01Q 1/24

[52] U.S. Cl. ..... 343/702

[58] Field of Search ..... 343/702, 829, 343/830; H01Q 1/24, 9/04

[56] References Cited

U.S. PATENT DOCUMENTS

| | | | |
|---|---|---|---|
| 4,584,585 | 4/1986 | Marko et al. | 343/702 |
| 4,641,366 | 2/1987 | Yokoyama et al. | 343/702 X |
| 4,876,552 | 10/1989 | Zakman | 343/702 |
| 5,144,324 | 9/1992 | Chin et al. | 343/702 |
| 5,365,246 | 11/1994 | Rasinger et al. | 343/702 |

FOREIGN PATENT DOCUMENTS 0604338 6/1994 European Pat. Off. ..... H01Q 1/24

*Primary Examiner*—Donald T. Hajec
*Assistant Examiner*—Tho Phan
*Attorney, Agent, or Firm*—Bo-In Lin

[57] ABSTRACT

A novel design of high frequency hidden hand-held antenna which includes two metal arms above a lower arm of finite ground plane. By properly choosing the lengths of these arms and the separations between them, the bandwidth can be broadened more than 20%. Thus, it is suitable for personal mobile communication applications. A full wave equivalent circuit analytic model is also developed to analyze and optimize the geometrical configuration including the lengths and separations between the arms. Numerical analyses for current distribution on the conductor surface and various antenna characteristics such as input impedance and radiation patterns are computed by the use of the analytical models. Experimental results and numerical computations all confirm that better performance characteristics including broadened antenna bandwidth are achieved by this novel antenna.

8 Claims, 18 Drawing Sheets

(a)

(b)

(a)

(b)

(a)

(b)

(c)

(a)

(b)

MULTI-RESONANCE HORIZONTAL-U SHAPED ANTENNA

BACKGROUND OF THE INVENTION

1. Field of the Invention

This invention relates generally to internal antenna for portable communication system. More particularly, this invention relates to new configuration and method for designing and manufacturing a multi-resonance horizontal-U shaped antenna to broaden the bandwidth of an internal antenna for portable communication system.

2. Description of the Prior Art

Conventional techniques for employing conducting plates or strips configured in different shapes as antennas for transmitting and receiving electromagnetic waves of different frequencies are limited by a major difficulty that the bandwidth provided by the antennas for such transmissions are not sufficiently broad. The demand for broader bandwidth is ever increased for portable communication systems as more communication transmissions are rapidly increased and greater crowd of users are causing 'traffic jams' in different frequency-bands.

Most of the traditional antennas employed by movable communication systems are extendible types including monopole antenna, whip antenna, sleeve antenna or normal mode helical antenna. It is well known fact in the art that the performance characteristics of these antennas are functions of the height of the antenna extended out of the rectangular metal box used to contain the communication system, e.g., a wireless telephone. Due the design considerations of simplicity, convenience of use, serviceability, reliability, and price, the external extendible antennas are increasingly being replaced by internal antennas. The internal antennas not only provides a design configuration to overcome the difficulties and limitations of the external antennas mentioned above, it further enhances the portability of the communication systems since the antennas can be conveniently placed in a pocket.

Among several types of internal antennas, the micro-strip antenna is most frequently being employed because of its low cost, small volume, light weight and easy to form on a flat surface. The microstip antennas however are limited by the narrow bandwidths. In order to resolve this difficulty, many other types of internal antenna are disclosed including the linear inverted-F antenna, planar inverted-F antenna. The linear inverted-F antenna was disclosed in early 1960s while the planar inverted-F antenna is to replace the linear radiation elements with planar elements. An inverted F-antenna can be considered as a quarter-wave microstrip antenna with air dielectric, matched by the RF-input stage by the position of the feed probe. Such feeds tend to restrict the antenna bandwidth defined by standing wave ratio, i.e., VSWR$\leqq$2. Since the bandwidth as defined by the acceptable radiation patterns is usually much larger than the VSWR bandwidth, additional matching network elements can be added to expand the VSWR bandwidth such that it can approximate the radiation bandwidth. However, this expansion is at the cost of decreasing the radiation efficiency of the antenna caused by non-ideal components of the matching network Rasinger et al. disclose a radiation coupled dual-L antenna which includes two narrow plates in the form of letter L on top of metallic shielding case. The narrow plates are arranged in parallel separated by a narrow slot. These two narrow plates are formed with equal length. This radiation-coupled dual-L antenna is intended to enhance the bandwidth of the antenna without requiring added matching network components thus enhanced bandwidth can be achieved without increasing the occupied volumes or consideration of matching network components. This enhanced bandwidth dual-L antenna has recently been published by Rasinger et al. in 1990 in IEEE Journal as attached herein. For ease of reference, please refer to FIG. 1A to 1E for different configurations of the prior art antennas as discussed above.

Rasinger et al. also applies a three-dimensional numerical analytical model i.e., an antenna wire-grid model to obtain calculated data of current distributions, 3-D radiation patterns, and input impedance at a fixed frequency. The analytical model enables an antenna designer to overcome the difficulties that experimental investigation of antenna performance is very time consuming as it depends on geometrical parameters and solder-intensive tinkering. Additionally, the measurement of radiation patterns in an anechoic chamber is very complex, expensive, and time consuming. The three dimensional wire-grid models, however, does not provide sufficient accuracy in defining the current distribution for a more complex antenna configuration. Furthermore, extra long computer execution time is required for performing such analyses when greater of number of grids is used. The technique of the 3-D wire-grid model is often not adequate to satisfy the need for modern antenna design.

Even that the dual-L antenna as disclosed by Rasinger is able to increase the bandwidth of the antenna without requiring the use of matching network components. However, since this dual-L antenna with the sum of the lengths of long and short arms equal to quarter wavelength, i.e., $L+H=\lambda/4$, it only has one resonant mode. The bandwidth enhancement is still very limited compared to the rapidly increased demand to accommodate a great number of users in the portable tele-communication market. Additionally, under the condition when the height of the antenna is less than quarter wavelength, i.e., $H<\lambda/4$, the potential improvements on matching impedance for performance improvement is very limited by changing the position of the feed probe.

Therefore, a need still exist in the art of design and manufacture of antenna for portable communication system to provide a new antenna configuration and design technique for broadening the bandwidth and for improving the impedance match characteristics of an antenna such that limitations and difficulties as now faced by the art of antenna design for portable communication devices can be resolved and more effective and higher performance applications of the portable communication systems can be achieved.

SUMMARY OF THE PRESENT INVENTION

It is therefore an object of the present invention to provide a new antenna configuration and design method to overcome the aforementioned difficulties encountered in the prior art.

Specifically, it is an object of the present invention to provide a new antenna configuration and design method by employing a multi-resonance horizontal-U shaped antenna to provide multiple resonance modes thus greatly expanding the bandwidth.

Another object of the present invention is to provide a new antenna configuration and design method by employing a multi-resonance horizontal-U shaped antenna to provide multiple resonant frequencies for performance improvements.

Another object of the present invention is to provide a new antenna configuration and design method by employing a novel design method for the multi-resonance horizontal-U shaped antenna of the present invention to improve the design accuracy and flexibility.

Briefly, in a preferred embodiment, the present invention discloses a horizontal-U shaped antenna which includes a conductive base plate including two vertically side plates extending upwardly from one edge of the base plate. The antenna further includes two horizontal conductive antenna arms of unequal lengths each connected to a corresponding side plate extending horizontally over the base plate. The two horizontal conductive antenna arms of unequal lengths and the two corresponding side plates connected thereto further are separated by an opening slot.

It is an advantage of the present invention that it provides a new antenna configuration and design method by employing a multi-resonance horizontal-U shaped antenna to provide multiple resonance modes thus greatly expanding the bandwidth.

Another advantage of the present invention is that it provides a new antenna configuration and design method by employing a multi-resonance horizontal-U shaped antenna to provide multiple resonant frequencies for performance improvements.

Another advantage of the present invention is that it provides a new antenna configuration and design method by employing a novel design method for the multi-resonance horizontal-U shaped antenna of the present invention to improve the design accuracy and flexibility.

These and other objects and advantages of the present invention will no doubt become obvious to those of ordinary skill in the art after having read the following detailed description of the preferred embodiment which is illustrated in the various drawing figures.

DETAILED DESCRIPTION OF THE PREFERRED EMBODIMENT

Figure 1A:
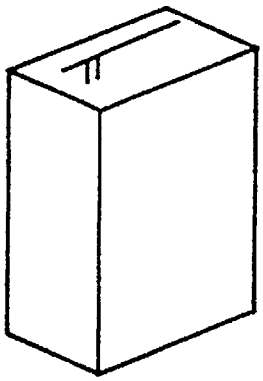
FIG. 1A Prior Art
FIGS. 1A to 1E are perspective views of the configurations of a series of prior art antennas.
Figure 1B:
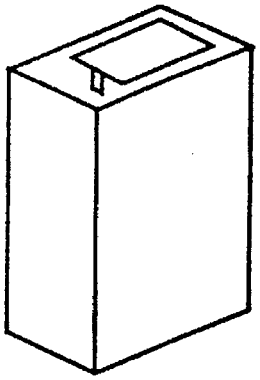
FIG. 1B Prior Art
Figure 1C:
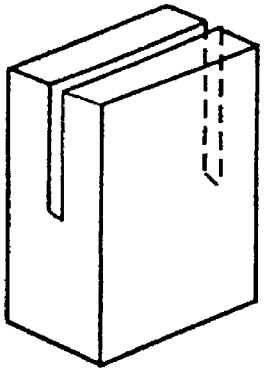
FIG. 1C Prior Art
Figure 1D:
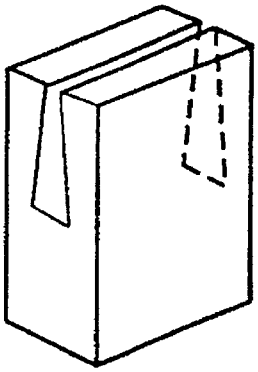
FIG. 1D Prior Art
Figure 1E:
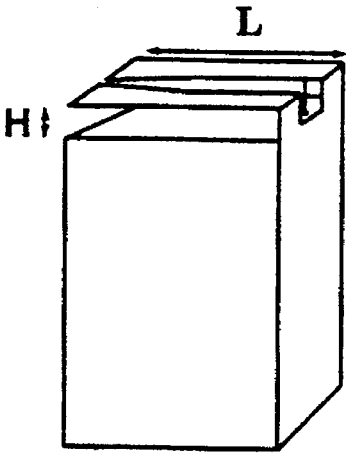
FIG. 1E Prior Art
Figure 2:
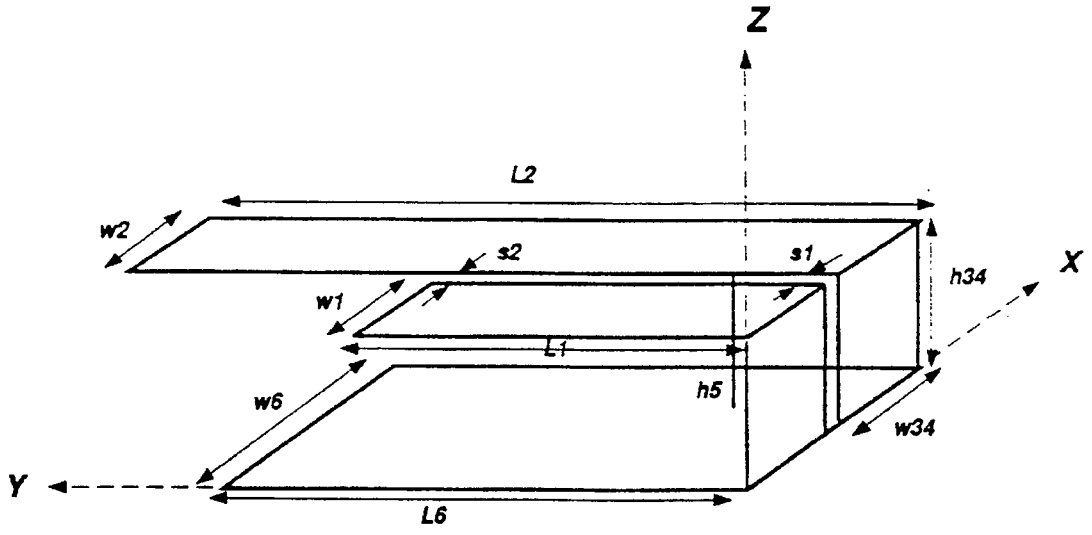
FIGS. 2 is a perspective view of a horizontal-U shaped antenna of the present invention.

FIG. 2 shows a new multi-resonance horizontal-U antenna 100 of the present invention before the antenna is attached to a box for containing communication system, e.g., a wireless telephone. The horizontal-U antenna 100 includes a base plate 110 of length L6 and two horizontal antenna arms 115 and 120 with arm lengths of L1 and L2 respectively. Each of these horizontal antenna arms 115 and 120 are connected to the base plate 110 via a side plate 122 and 124 respectively. A set of preferred dimensions of the antenna 100 are shown wherein the lengths L1, L2, and L6 are all of different values. The feedline 125 from the communication system is extended from a via 130 on the base plate 110 to be in contact with the horizontal antenna arm 120.

Figure 3:
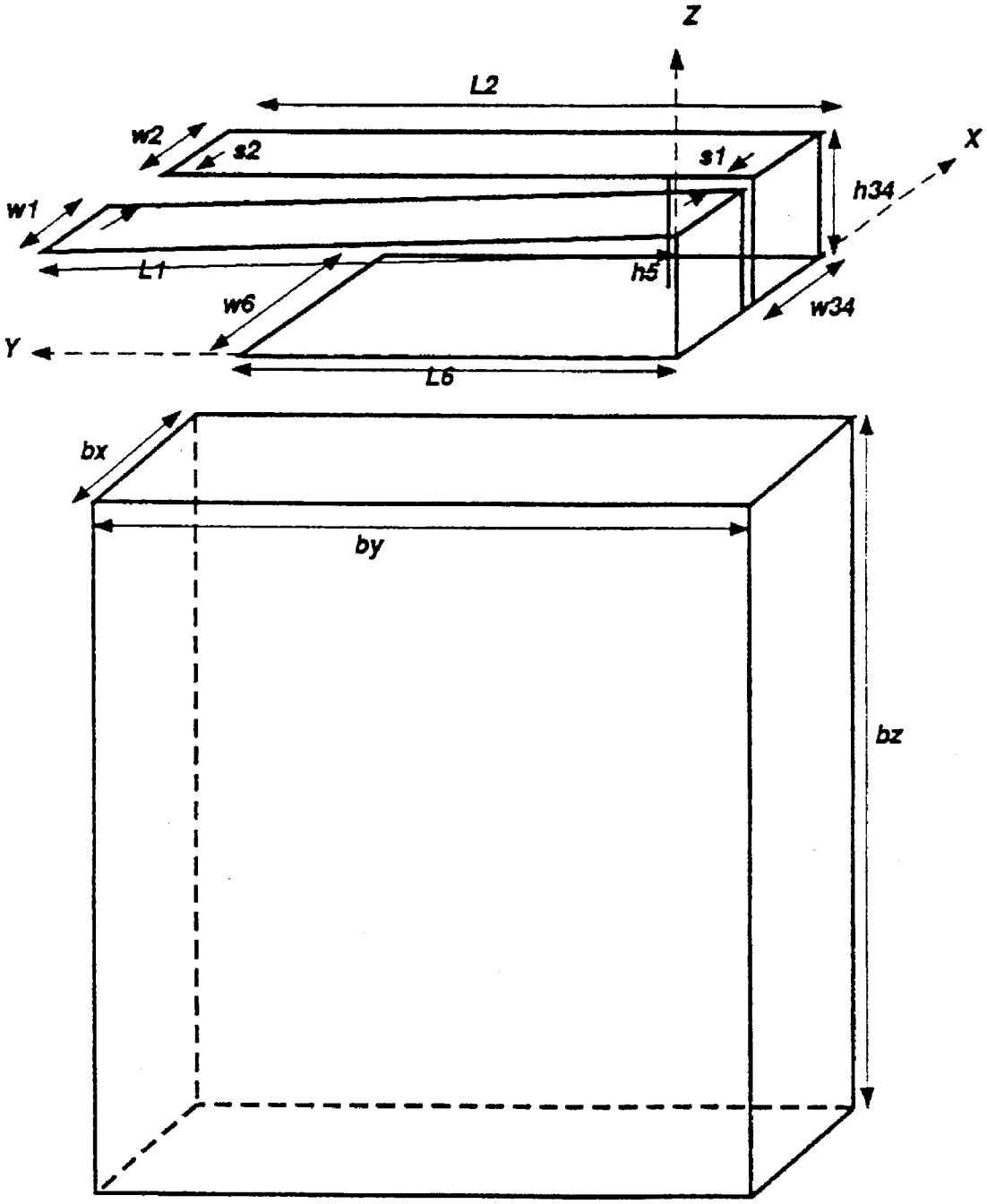
FIGS. 3 is a perspective view of another horizontal-U shaped antenna of the present invention attached to a containing box.

FIG. 3 shows another preferred embodiment of the present invention where a multi-resonance horizontal-U antenna 200 is provided to be attached to a box 250 for containing a communication system therein. Similar to the horizontal-U antenna 100 as shown in FIG. 1, the horizontal-U antenna 200 also includes a base plate 210 and two horizontal antenna arms 215 and 220 which are connected to the base plate 210 via two side plates 222 and 224 respectively. A set of dimensions of a preferred embodiment is shown in FIG. 2 also. The upper cover of the box 250 is composed of plastic material such that minimum interference is caused by the upper cover which is right underneath the base plate 210. Other parts of the containing box 210 are composed of material coated with metallic paints to function as electromagnetic wave, i.e., E-M wave, radiating body.

In a preferred embodiment, the present invention discloses a horizontal-U shaped antenna 100 which includes a conductive base plate 110 including two vertically side plates 122 and 124 extending upwardly from one edge of the base plate 110. The antenna 100 further includes two horizontal conductive antenna arms 115 and 120 of unequal lengths each connected to a corresponding side plate 122 and 124 respectively, extending horizontally over the base plate 110. The two horizontal conductive antenna arms 115 and 120 of unequal lengths and the two corresponding side plates 122 and 124 connected thereto further are separated by an opening slot.

In order to more fully appreciate the advantages and the underlying physics of these novel and improved antenna configurations, a new analytical model is first described. The performance parameters of the antenna of this invention are first computed by the use of this new analytical model. Results of actual measurements are then compared with the calculated data. The computational results in combination with the actual measurements present clear explanations and proofs that (1) the antenna of this invention is superior in performance and is able to provide more design flexibility, and (2) the new analytical is more accurate and require less computer time and thus providing better design techniques for use in modern antenna design processes.

Instead of dividing an antenna into a plurality of 'wire grids' and simulating the currents flowing through these wires, the antenna is now managed as it is formed with a plurality of 'cells' in a new analytical model i.e., the full wave equivalent circuit model. The cells can be rectangles, triangles, or even a wire. The antennas of the present invention as that shown in FIGS. 2 and 3 can be modeled as FIGS. 4 and 5 respectively. The details of the full wave equivalent circuit model including the electromagnetic equations employed to model the antenna as equivalent circuits are presented in Appendix A.

Figure 6:
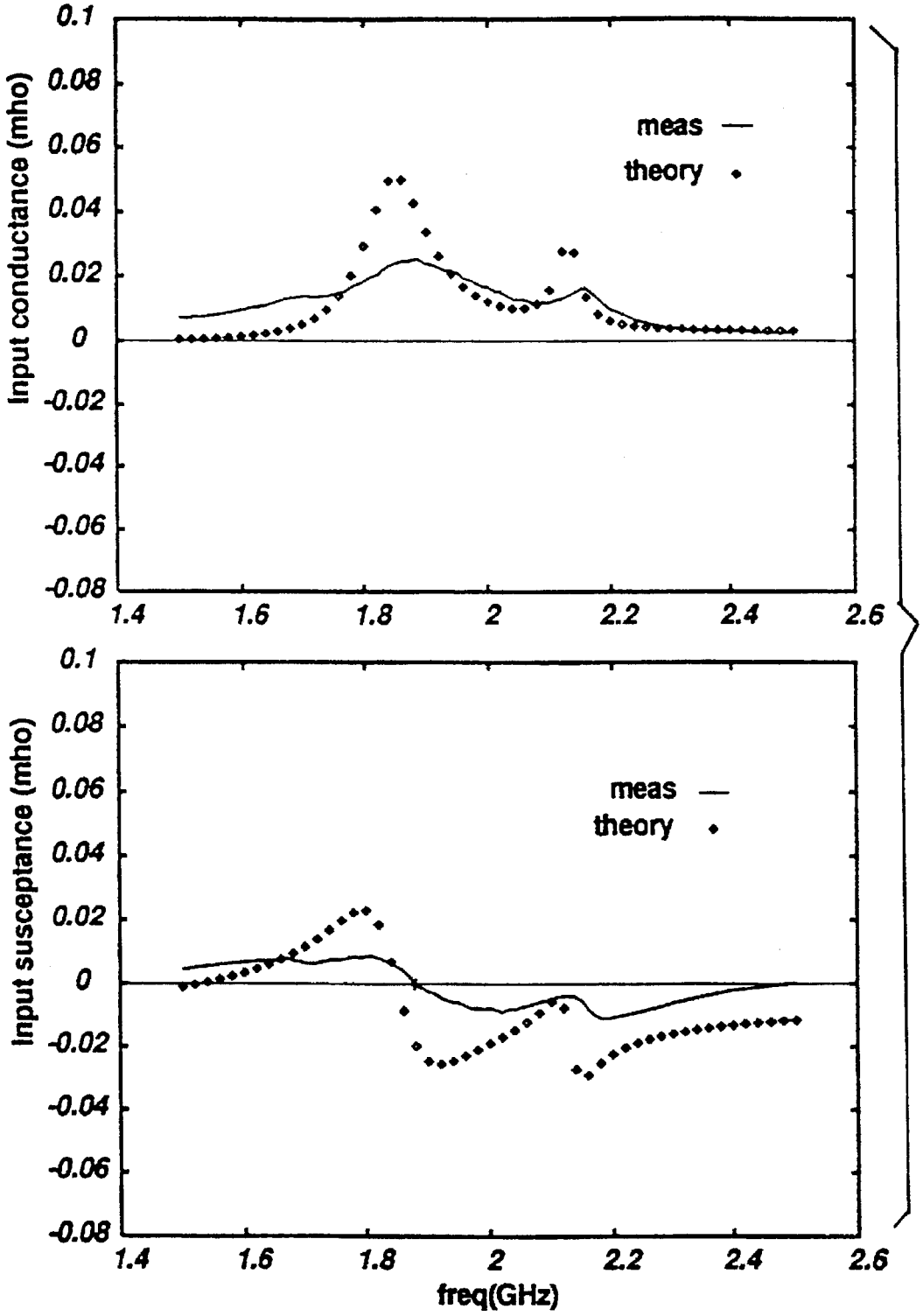
FIG. 6 shows the variations of the input conductance and susceptance as function of frequency of the antenna of FIG. 2.
Figure 7:
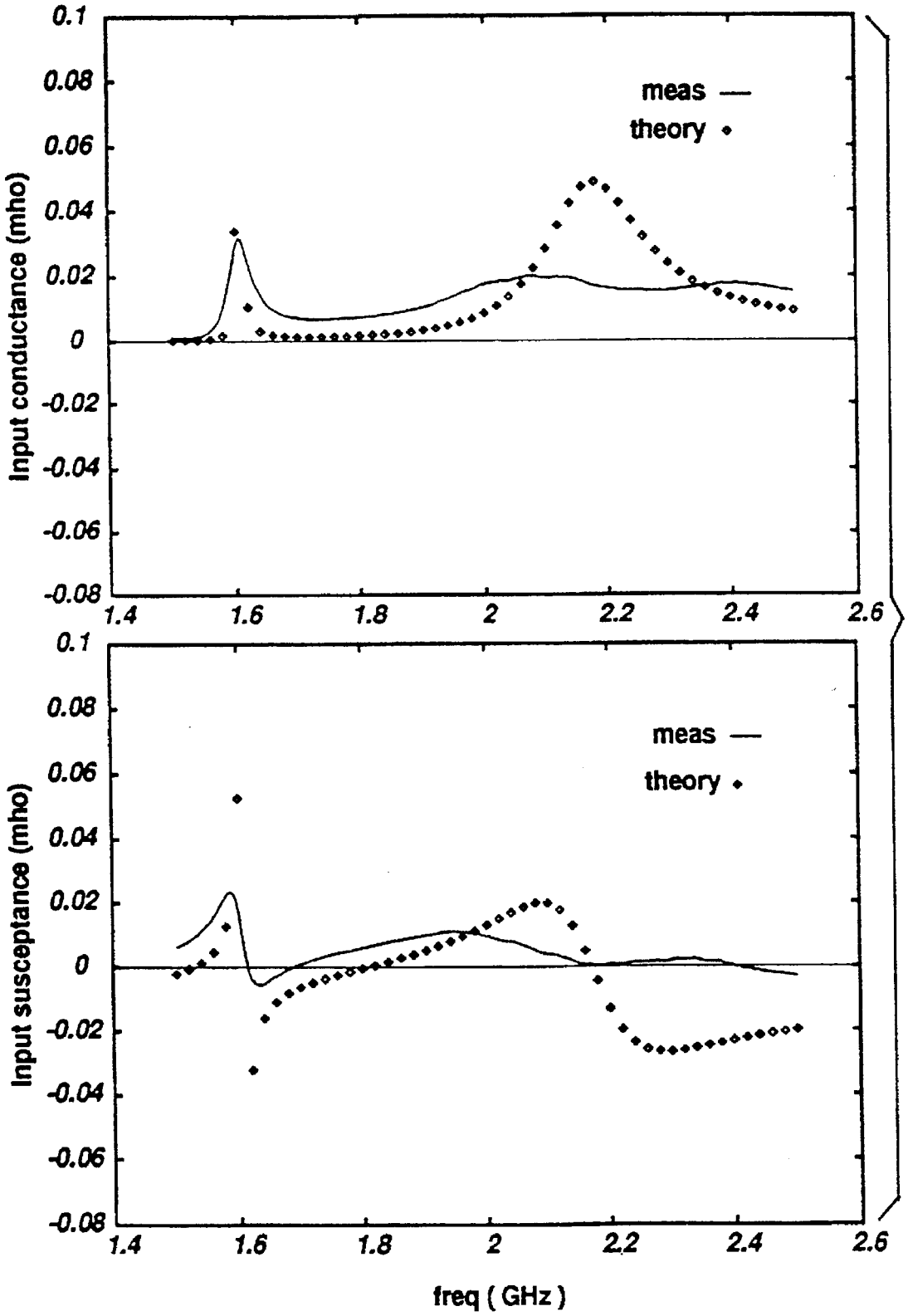
FIG. 7 shows the variations of the input conductance and susceptance as function of frequency of the antenna of FIG. 3 without the containing box.
Figure 8:
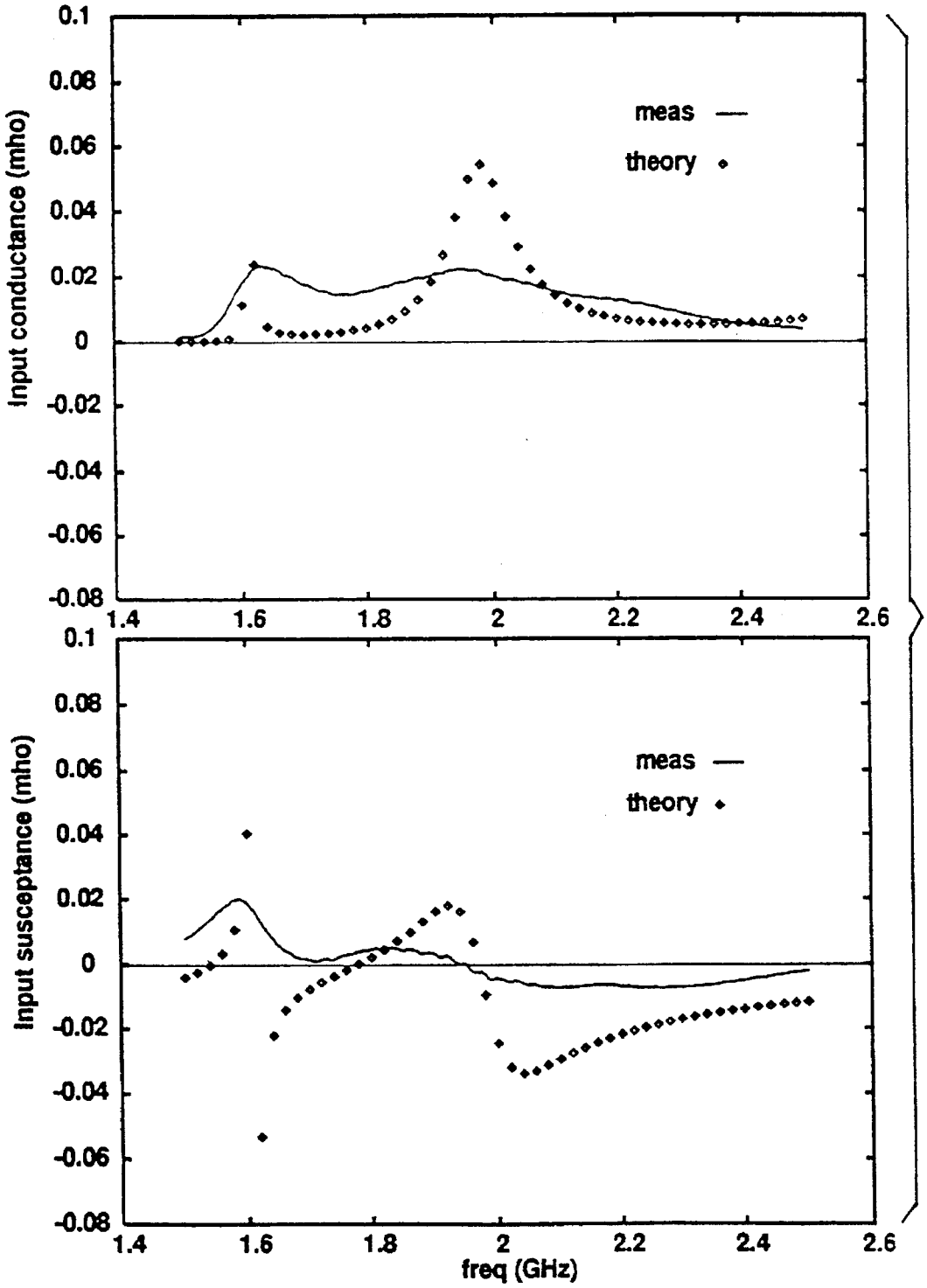
FIG. 8 shows the variations of the input conductance and susceptance as function of frequency of the antenna of FIG. 3 with the containing box.
Figure 9:
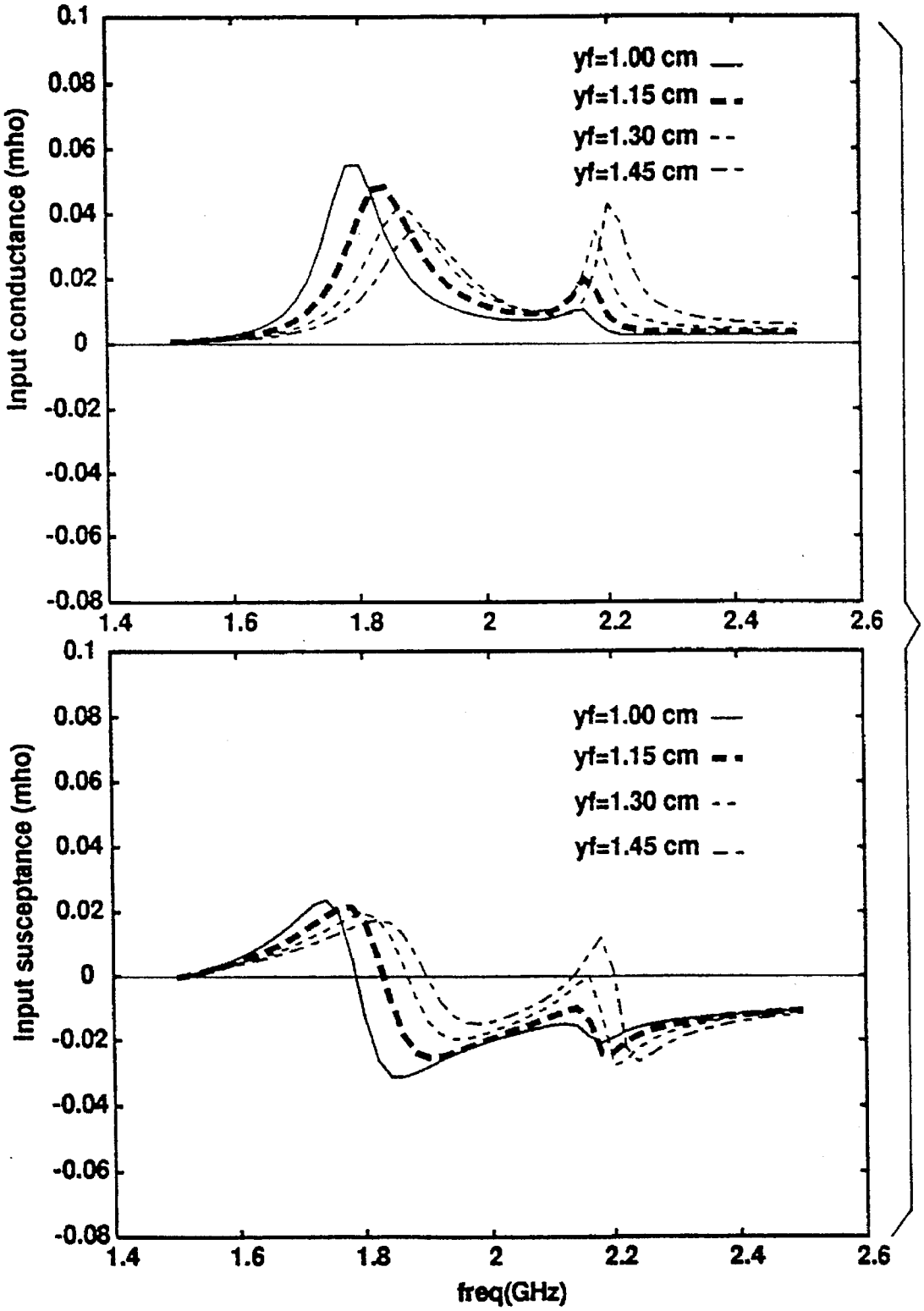
FIG. 9 shows the variations of the input conductance and susceptance as function of frequency of the antenna of FIG. 2 with feed probe placed at different positions.
Figure 10:
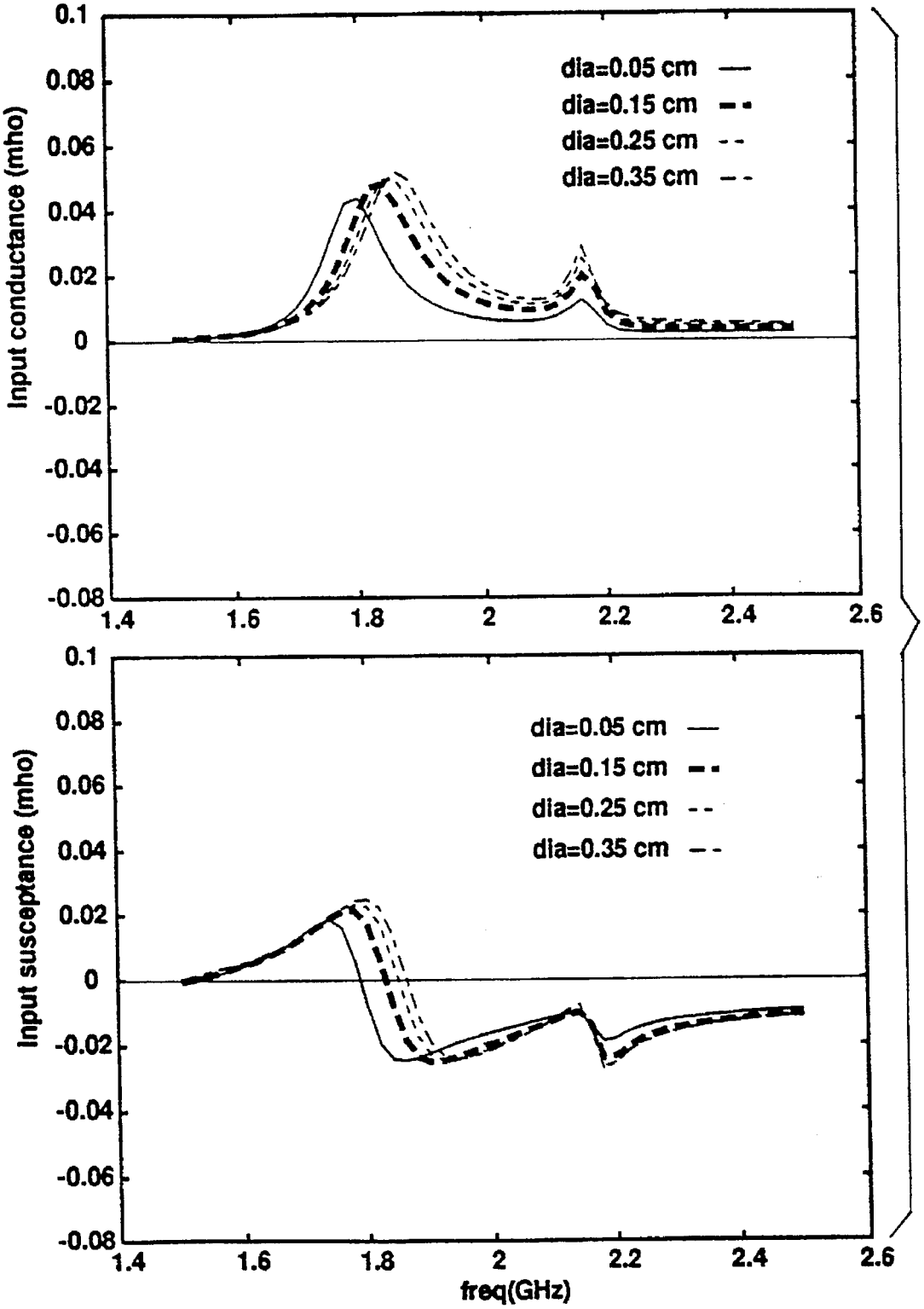
FIG. 10 shows the variations of the input conductance and susceptance as function of frequency of the antenna of FIG. 2 with feed probes of different diameters.

The calculated and measured input conductance and input susceptance for the multi-resonant horizontal-U antenna 100 is shown in FIG. 6. It is very clear that antenna 100 has two resonant modes. The first resonant mode occurs at 1.87 GHz and the second resonant mode occurs around 2.17 GHz. Similar to FIG. 6, FIGS. 7 and 8 show the input conductance and input susceptance for the antenna 200 without and with the containing box respectively. In examining the data shown in these two figures, it is found that as a result of adding the containing box, the first resonance frequency is changed from 1.605 GHz to 1.7 GHz, and the second resonance frequency is changed from 2.17 to 1.95 GHz. As these two resonance frequencies are drawn closer, the bandwidth is expanded. FIG. 9 shows the variation of calculated input conductance and input susceptance as function of the feed probe positions, i.e., $y_f$ when all other parameters are maintained the same. The relative frequency difference between two resonant frequencies remains substantially unchanged while the two resonant frequencies move higher as $y_f$ is increased. FIG. 10 shows the variation of calculated input conductance and input susceptance as function of the diameter of the feed probe. The first resonant frequency moves higher as the diameter of the feed prove is increased while the second resonant frequency does not change.

Figure 11A:
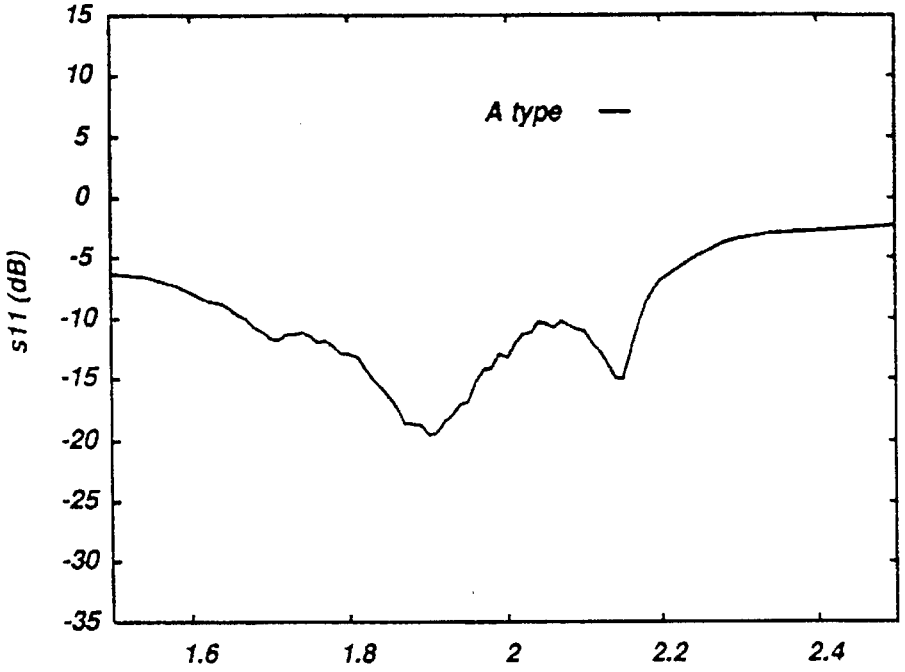
FIG. 11 shows the variations of the reflection coefficient as function of frequency of the antennas of FIG. 2 and FIG. 3.
Figure 11B:
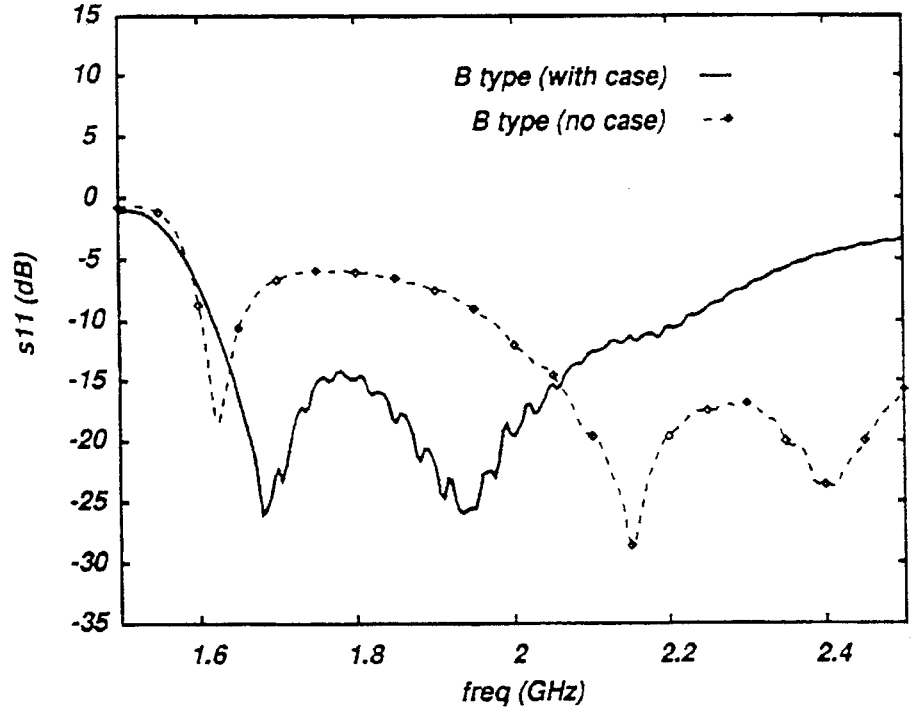
Figure 12A:
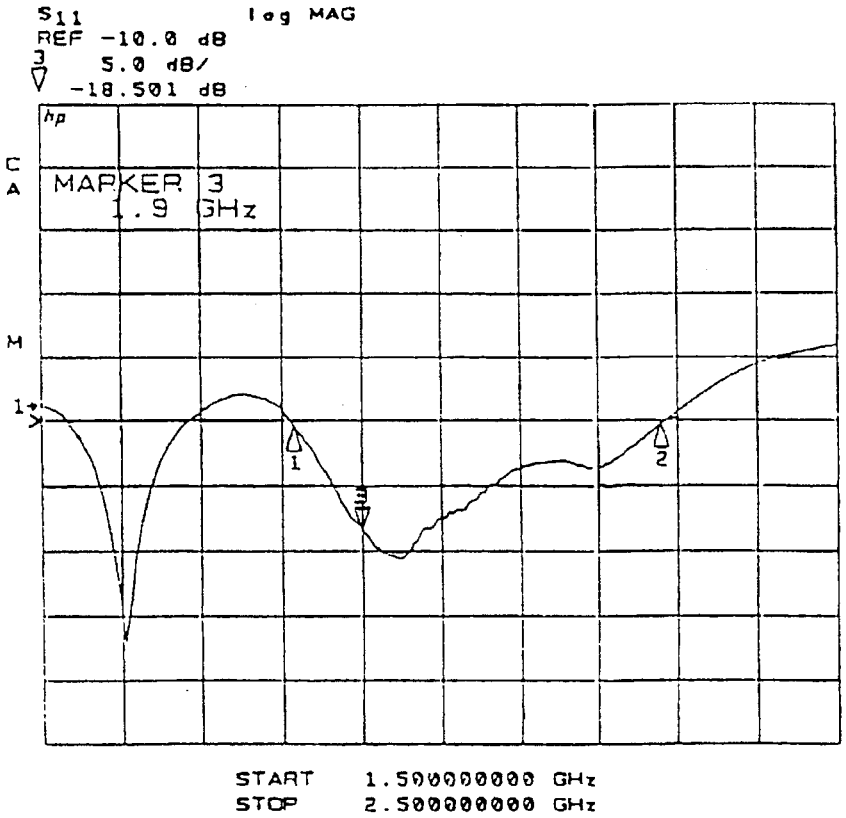
FIG. 12 shows the variations of the reflection coefficient as function of frequency of the antenna of FIG. 3 with uniform opening slot and tapered opening slot.
Figure 12B:
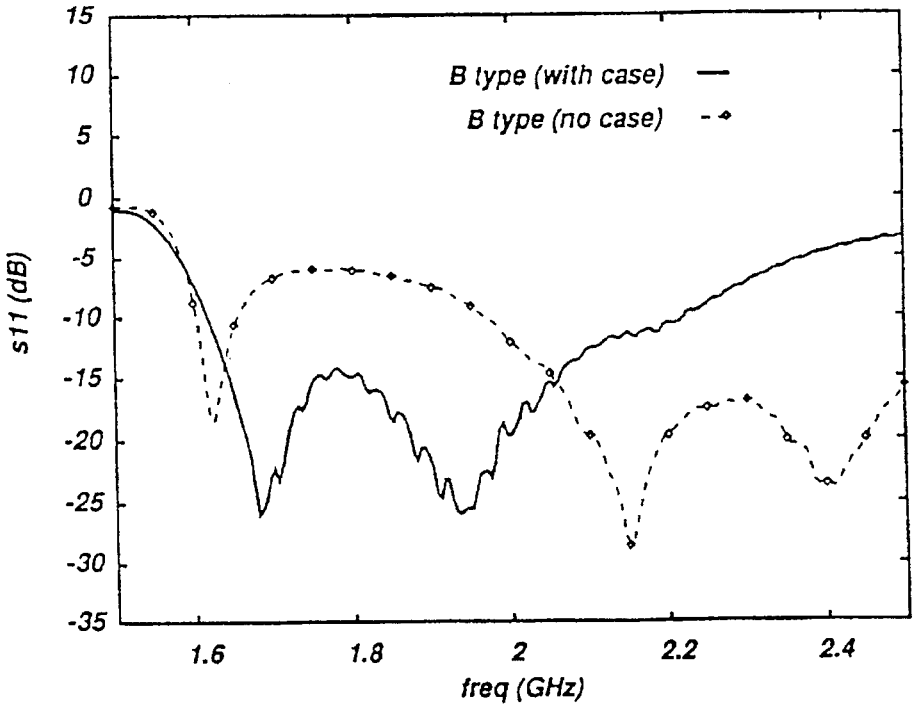
Figure 13:
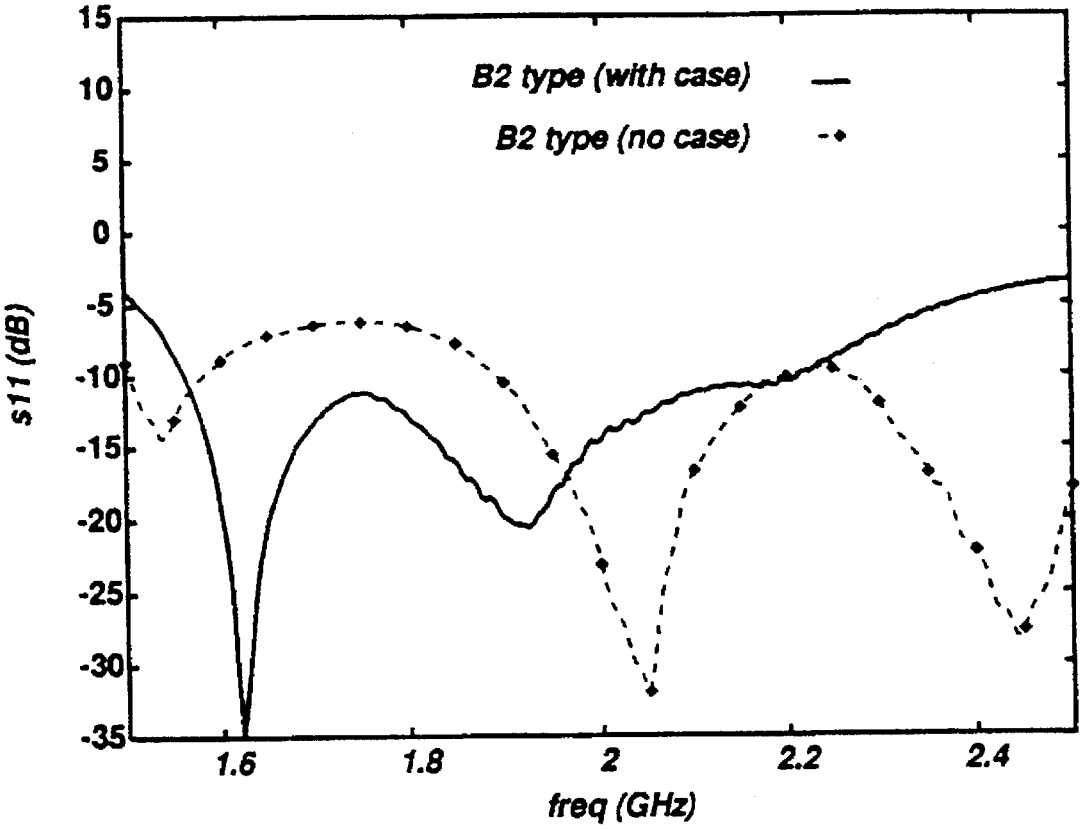
FIG. 13 shows the variations of the reflection coefficient as function of frequency of another antenna with and without the containing box.

As the bandwidth is defined as the value of voltage standing wave ratio (VSWR) less than 2.0, or the reflection coefficient, i.e., S11, is less than −10 dB. FIG. 11A shows the reflection coefficient for antenna 100 (FIG. 2) where a 20% is achieved around a resonant frequency around 1.9 GHz, and FIG. 11B shows the reflection coefficient for antenna 200 (FIG. 3) wherein two curves are shown for the reflection coefficient of antenna 200 with and without the containing box respectively and a bandwidth of about 25% is achieved. FIG. 12A and FIG. 12B show the reflection coefficient of the antenna 200 with uniform slot and tapered slot respectively. In FIG. 12A, the reflection coefficient between 1.7 and 1.8 GHz is greater than −10 dB and this section of bandwidth is not useful. By varying the slot $S_2$ from 0.1 cm to 0.65 cm, that limitation is removed. FIG. 12B further shows that the containing box tends to lower the resonance frequencies and also improve the bandwidth. As shown in Table 1 below, seven sets of dimensions, i.e., design A, to B5 are employed for designing the antenna for determination of antenna performance characteristics where type A is for antenna along and type B is for antennas designed with a box for containing a cordless phone therein. It is noted that B5 is for a horizontal-U shaped antenna where there is no opening slot between two horizontal upper arms. An example of the reflection coefficient for design B2 is shown in FIG. 13 where a bandwidth greater than 25% is achieved.

Figure 14A:
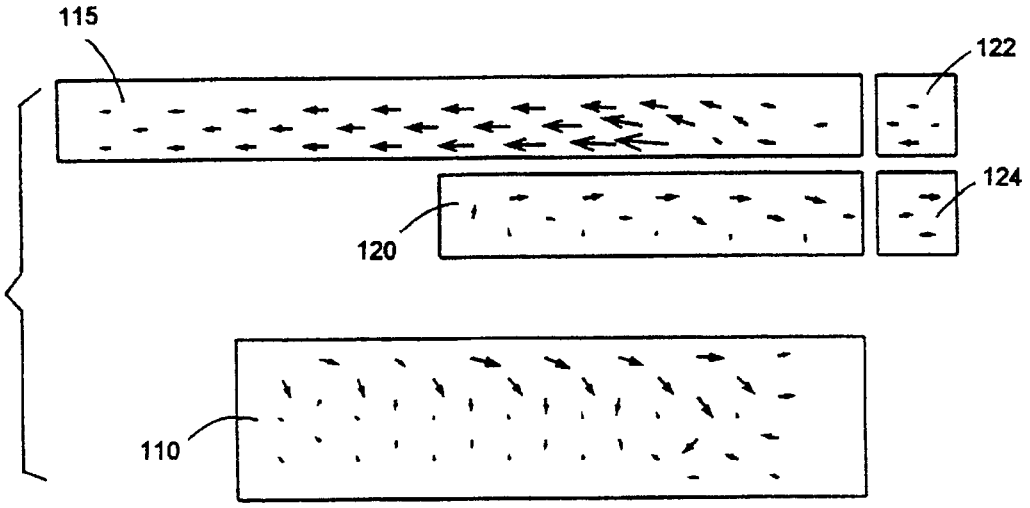
FIG. 14 shows the current distribution on the surface of the antenna of FIG. 2 at two resonant frequencies.
Figure 14B:
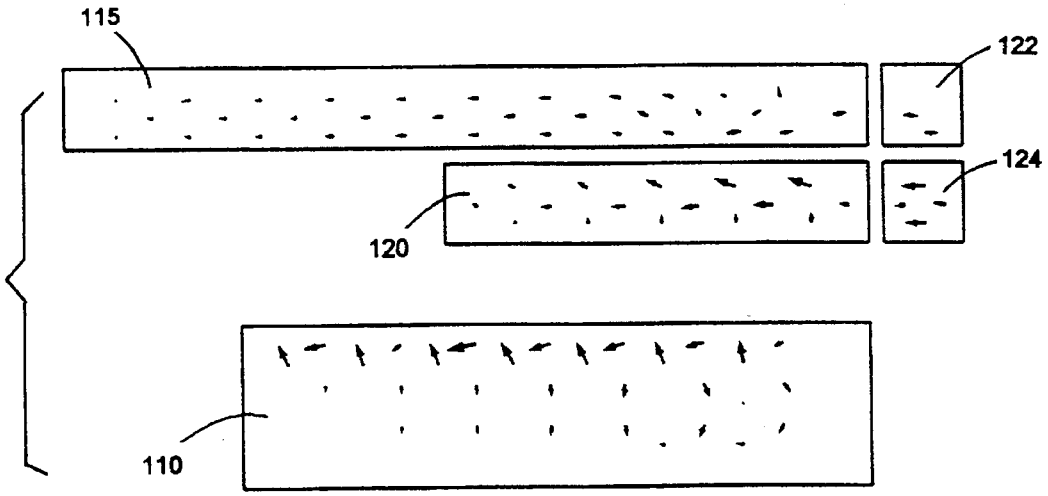
Figure 15A:
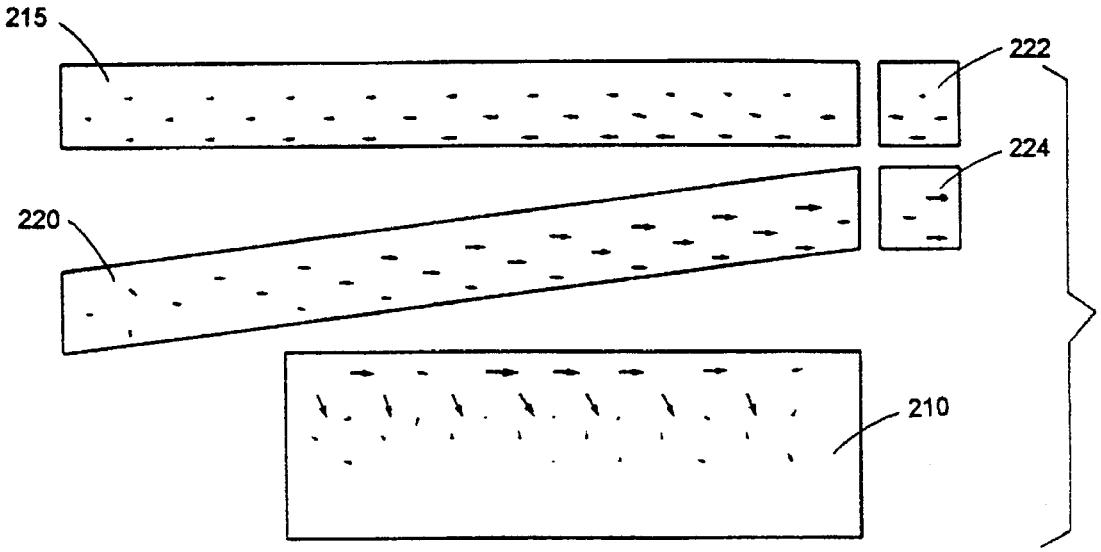
FIG. 15 shows the current distribution on the surface of the antenna of FIG. 3 at two resonant frequencies.
Figure 15B:
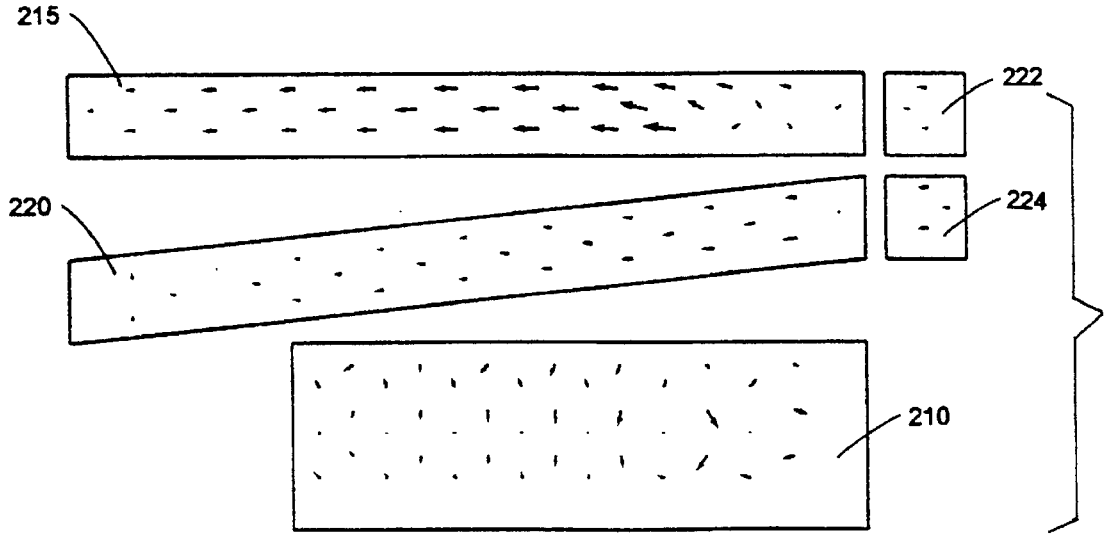

FIGS. 14A and 14B show the current distributions, at frequencies 1.87 GHz and 2.16 GHz respectively, on the surface of the base plate 110, two horizontal antenna arms 115 and 120, and two side plates 122 and 124 of a type A antenna 100 in FIG. 2. At frequency 1.87 GHz, the currents in two horizontal antenna arms 115 and 120 are in opposite directions while at 2.16 GHz they are in the same direction. The first resonance is induced by the currents in the two horizontal antenna arms 115 and 120 wherein L1+L2 is approximately λ/2. While the second resonance is induced by the first antenna arm 115 and the base plate 110, thus L1+L6 is approximately λ/2. FIGS. 15A and 15B show the current distributions, at frequencies 1.605 GHz and 2.17 GHz respectively, on the surface of the base plate 210, two horizontal antenna arms 215 and 220, and two side plates 222 and 224 of a type B antenna 200 in FIG. 3. At frequency 1.605 GHz, the currents in two horizontal antenna arms 215 and 220 are in opposite directions while at 2.17 GHz they are in the same direction. The first resonance is induced by the currents in the two horizontal antenna arms 215 and 220 wherein L1+L2 is approximately λ/2. While at the second resonance frequency 2.17 GHz, the current density on arm 220 is greater than 215 thus the resonance is more related to arm 220 than arm 215. The second resonance is induced by the current flow from the base plate 210 through the feed probe to the second arm 220 and forming a length of approximately half wave length, i.e., $(L_2-y_f)+h_5+(L_6-y_f)=\lambda/2$ where $y_f$ is the distance between the contact point of the feed probe from the edge of the horizontal arm connected to the side plates 222 and 224.

Figure 16:
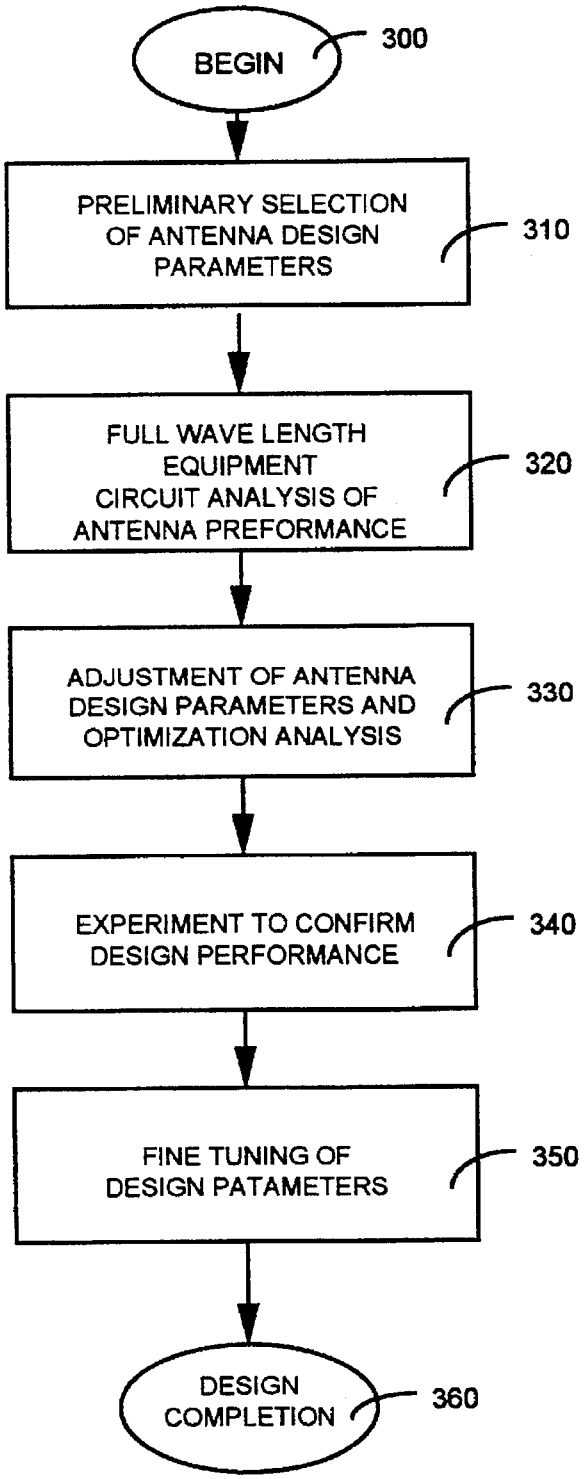
FIG. 16 is a flowchart showing a design procedure for a multiple resonance horizontal U-shaped antenna applying a full wavelength equivalent circuit technique of this invention.

For a multiple-resonance horizontal U-shaped antenna, the full wave length analysis technique as outlined above can be employed to simplify the design process and to optimize the design parameters as that shown in a flow chart in FIG. 16. The process begins (step 300) by making a preliminary selection of the lengths of the base plate, the horizontal antenna arms, e.g., L1, L2, and L6, and the position of the feed probe (step 310). The preliminary selection is be guided by the equations either L1+L2 is approximately to be λ/2 or $(L_2-y_f)+h_5+(L_6-y_f)=\lambda/2$. A full wavelength equivalent circuit analysis is then performed (step 320) to calculate the performance parameters such as the resonance frequencies, bandwidth, input impedance and radiation pattern. Based on the calculated results, the geometrical parameters of the antenna are then adjusted and further analyses are performed iteratively to optimize the antenna performance depending on the operation requirement specification of the antenna (step 330). An experiment is then carried out to confirm the performance based on the analysis data (step 340). Further adjustments are made to fine tune the design (step 350) before the design process is completed (step 360). A design is then provided with an effective design process by the use of the full wavelength equivalent technique to achieve optimal design of an antenna in a predictable and controllable manner.

This invention also discloses a method of generating multiple-resonance modes of operation in a horizontal-U shaped antenna which includes a conductive base plate of length L6 having two vertically side plates extending upwardly from one edge of the base plate and two horizontal conductive antenna arms of unequal lengths L1 and L2 respectively each connected to a corresponding side plate and extending horizontally over the base plate. The method includes a step of adjusting the lengths of the L1, L2 and L6 whereby L1+L2 and L1+L6 are both approximately half of the wavelength λ corresponding to a main resonance frequency.

A method of generating multiple-resonance mode of operation in a horizontal-U shaped antenna is also disclosed in this invention which includes thereof: (a) forming a base plate having multiple vertically side plates extending upwardly from one edge of the base plate; (b) forming multiple horizontal conductive antenna arms corresponding to each of the vertical side plates each being of unequal length and being connected to the corresponding side plate and extending horizontally over the base plate; and (c) adjusting the lengths of the base plates and each of the horizontal antenna arms for achieving the multiple-resonance mode of operation.

This invention further discloses a method of designing a multiple-resonance horizontal-U shaped antenna which includes a base plate having multiple vertically side plates extending upwardly from one edge of the base plate and multiple horizontal conductive antenna arms corresponding to each of the vertical side plates each being of unequal length and being connected to the corresponding side plate and extending horizontally over the base plate. This method can be computerized such that automated design procedure can be carried out to achieve savings of human efforts. The method includes the steps of: (a) making a preliminary selection of a plurality of geometrical parameters of the antenna, e.g., step 310; (b) performing a full wavelength equivalent circuit analysis with the geometrical parameters for the antenna for obtaining several performance variables, e.g., step 320; (c) comparing the performance variables with a set of targeted performance variables; and (d) adjusting the lengths of the base plates and each of the horizontal antenna arms for achieving an optimal design wherein the performance variables being most approximating to the target performance variables, i.e., step 350.

This invention thus discloses a novel design of high frequency hidden hand-held antenna which includes two metal arms above a lower arm of finite ground plane. By properly choosing the lengths of these arms and the separations between them, the bandwidth can be broadened more than 20%. Thus, it is suitable for personal mobile communication applications. A full wave equivalent circuit analytic model is also developed to analyze and optimize the geometrical configuration including the lengths and separations between the arms. Numerical analyses for current distribution on the conductor surface and various antenna characteristics such as input impedance and radiation patterns are computed by the use of the analytical models. Experimental results and numerical computations all confirm that better performance characteristics including broadened antenna bandwidth are achieved by this novel antenna.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

TABLE 1*

| PARAMETER\ Type | A | B | B1 | B2 | B3 | B4 | B5** |
|---|---|---|---|---|---|---|---|
| L1 | 2.8 | 4.8 | 6.1 | 5.8 | 4.3 | 5.0 | 4.8 |
| W1 | .45 | .45 | .45 | .45 | .45 | .45 | N/A |
| L2 | 5.27 | 4.7 | 4.8 | 4.8 | 4.3 | 5.0 | 4.8 |
| W2 | .45 | .45 | .45 | .45 | .45 | .45 | N/A |
| h34 | 0.5 | 0.5 | 0.5 | 0.5 | 1.0 | 0.3 | 0.5 |
| W34 | .45 | .45 | .45 | .45 | .45 | .45 | N/A |
| h5 | 0.5 | 0.5 | 0.5 | 0.5 | 1.0 | 0.3 | 0.5 |
| L6 | 4.0 | 3.4 | 3.4 | 3.3 | 3.4 | 3.4 | 3.4 |
| W6 | 1.0 | 1.0 | 1.0 | 1.0 | 1.0 | 1.0 | 1.0 |
| yf | 1.0 | 1.0 | 1.0 | 1.0 | 1.0 | 1.0 | 1.0 |
| s1 | 0.1 | 0.1 | 0.1 | 0.1 | 0.1 | 0.1 | 0 |
| s2 | 0.1 | 0.65 | 0.45 | 0.25 | 0.1 | 0.1 | 0 |
| bx | N/A | 3.5 | 3.5 | 3.5 | 3.5 | 3.5 | 3.5 |
| by | N/A | 6.0 | 6.0 | 6.0 | 6.0 | 6.0 | 6.0 |
| bz | N/A | 20.0 | 20.0 | 20.0 | 20.0 | 20.0 | 20.0 |

*All parameters have dimensions defined in CM
**B5 is a type which has no opening slot.

Appendix A

Figure 4:
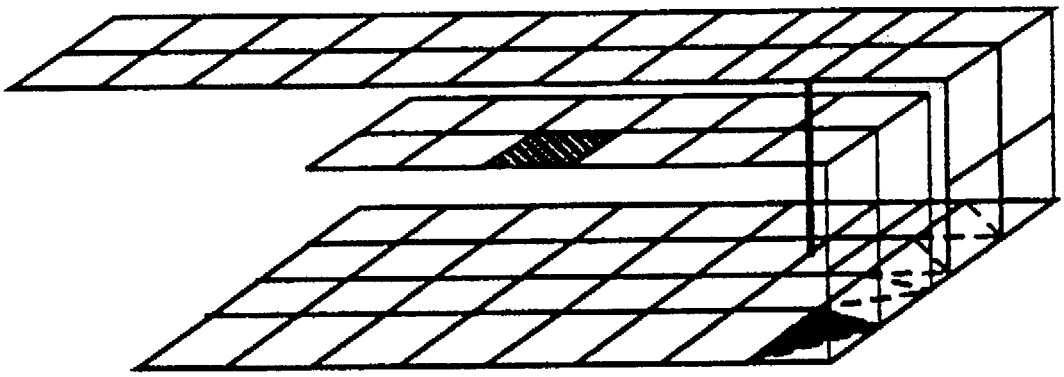
FIGS. 4 is a perspective view of a horizontal-U shaped antenna of FIG. 2 which being divided into a plurality of cells for numerical analysis of the present invention.
Figure 5:
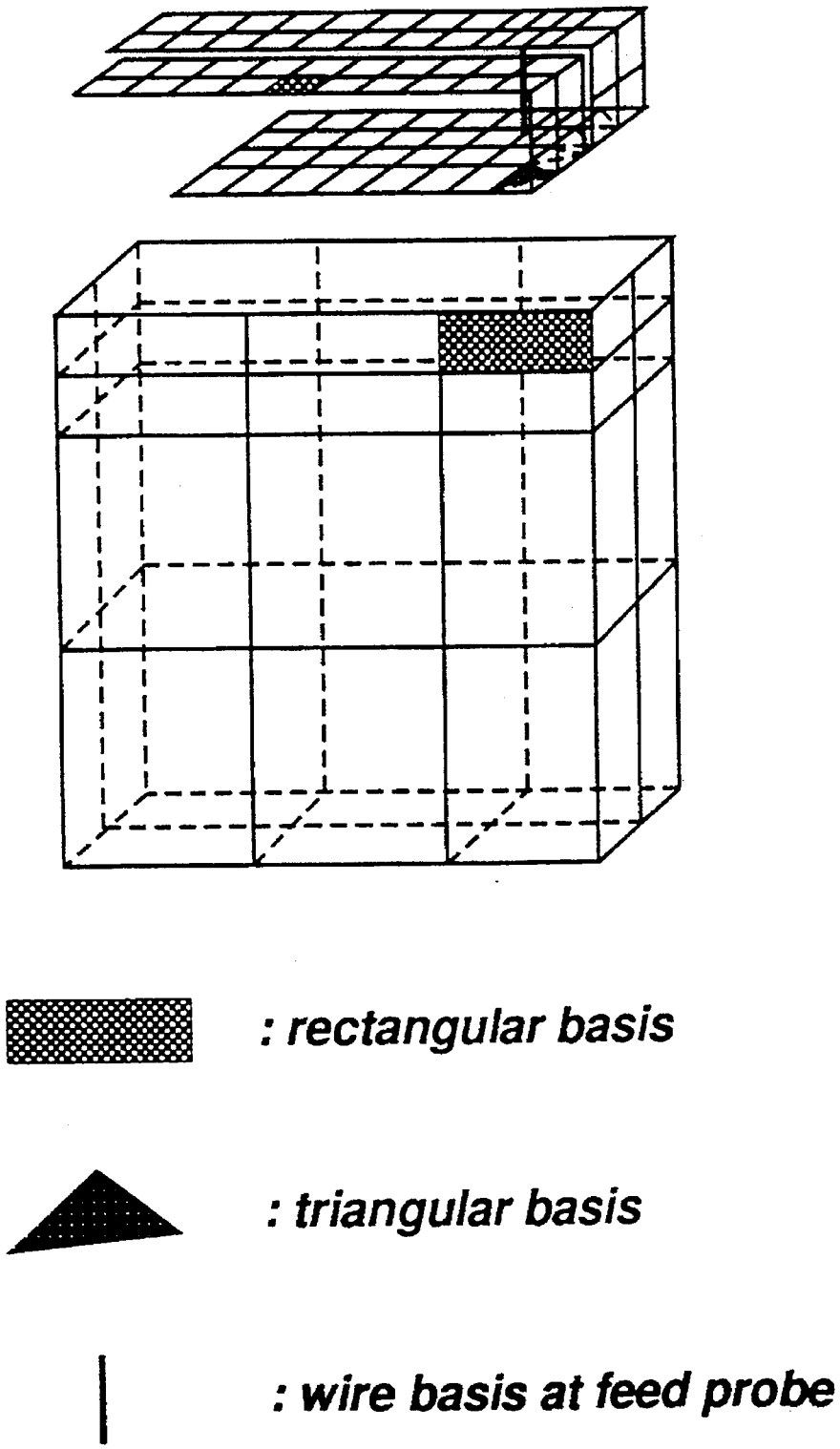
FIGS. 5 is a perspective view of a horizontal-U shaped antenna of FIG. 3 which being divided into a plurality of cells for numerical analysis of the present invention.

The current J(r) on the surface of the multi-resonant horizontal-U shaped antenna 100 as that shown in FIG. 4 can be expressed as:

$$E^s(r)=-j\omega A(r)-\nabla\Phi(r) \tag{A-1}$$

and the magnetic vector potential A(r) and the electric scalar potential Φ(r) can be represented as $$A(r)=\int_{\Omega}\frac{\mu_0 e^{-jkR}}{4\pi R}J(r')d\Omega' \tag{A-2}$$

$$\Phi(r)=\int_{\Omega}\frac{e^{-jkR}}{4\pi\epsilon_0 R}\rho(r')d\Omega' \tag{A-3}$$

where R=|r−r'| which is the distance between the source of the electromagnetic (E-M) wave r' and the position of observation r. The charge density ρ(r) may be obtained as:

$$\rho(r)=(-1/j\omega)\nabla s\cdot J(r) \tag{A-4}$$

where ∇s represents a derivative on the surface of the conductive metal.

The tangential component of total electrical field over the surface of the metal surface satisfies a condition represented by:

$$E_t^i(r)+E_t^s(r)=Z_s J(r) \tag{A-5}$$

where the subscript t representing a tangent component and $E^i(r)$ defines the incident electrical field from the E-M wave source. And, $$Z_s=\sqrt{\frac{j\omega\mu}{\sigma}} \tag{A-6}$$

which is surface impedance. The solution for the surface current J(r) can be obtained by substituting equations A-1 to A-4 into Equation A-5.

Figure 17A:
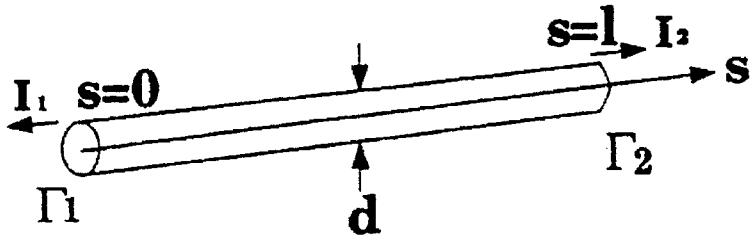
FIGS. 17*a* to 17*c* show the cell elements used in the full wavelength equivalent circuit technique of this invention.
Figure 17B:
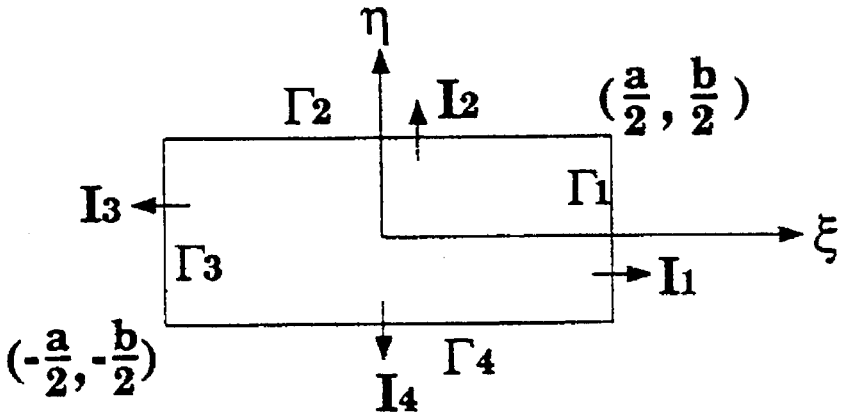
Figure 17C:
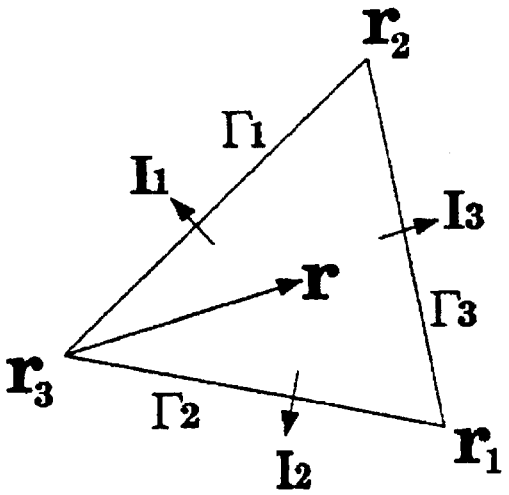
Figure 18A:
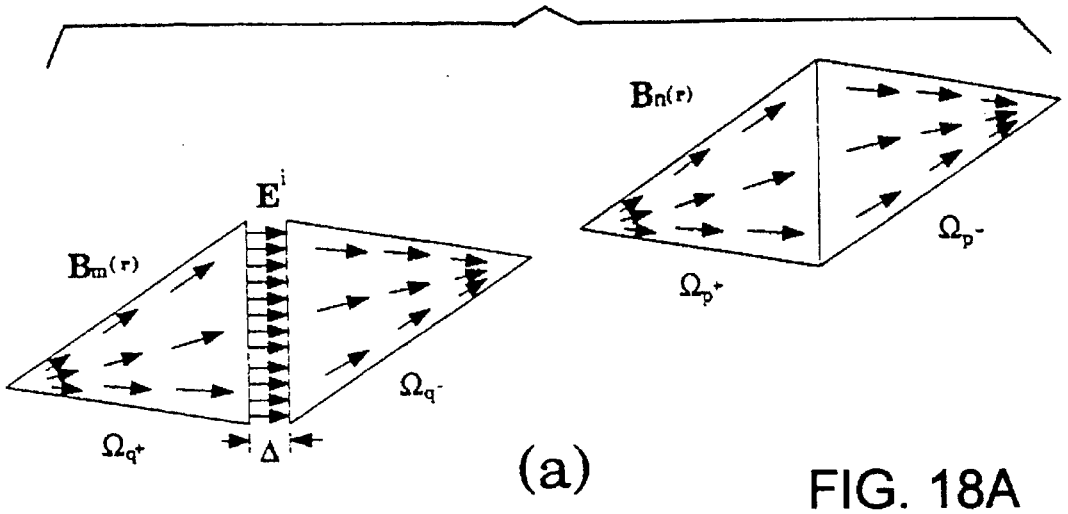
FIGS. 18*a* and 18*b* shows the surface current in a cell element and the equivalent circuits for the full wavelength equivalent circuit technique of this invention.
Figure 18B:
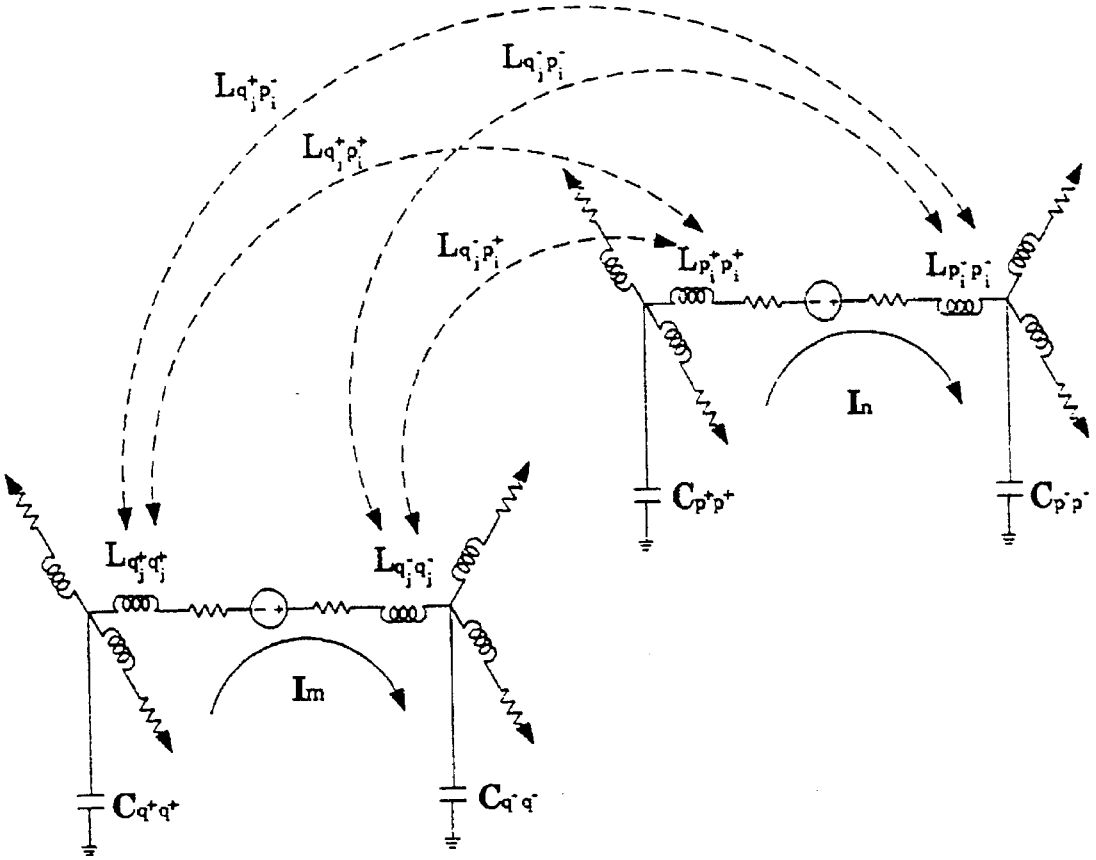

In order to obtain the value of J(r), the metal surface is divided Into many cell elements and the current in each cell is then represented as simple functions which approximate the current density. As shown in FIG. 17*a* to 17*c*, there are three kinds of cell elements, i.e., a wire cell, a triangle cell, and a rectangular cell. For the modeling of the U-shaped antenna, majority of the cells are rectangular cells, while the intersection parts between the base plate and vertical arms are modeled by the use of triangle cells. The feed probe is modeled by the use of wire cells. The following descriptions provide equations for modeling these different types of cells:

I. Wire Cell Model

As shown in FIG. 17*a*, the length of the line is l and the diameter is d, and the current density can be defined as:

$$J(s)=I_1B_1(s)+I_2B_2(s) \tag{A-7}$$

where s representing a coordinate along the line and the basis functions can be defined as:

$$B_1(s)=-\frac{l-s}{\pi dl}\,\hat{s};\qquad B_2(s)=\frac{s}{\pi dl}\,\hat{s}$$

When an integration of the basis functions are performed along the edge at the end portion, the unknowns I1 and I2 in Equation A-7 may be represented as the current outputs. The charge density corresponding to the current density obtained from the basis function can be derived from Equation A-4 as:

$$\rho(s)=Q\cdot\Pi(s)$$

where $$\Pi(s)=\nabla_s\cdot B_i(s)=\frac{\partial(B_i(s)\cdot\hat{s})}{\partial S}=\frac{1}{\pi dl}=\frac{1}{A}\ (i=1,2)$$

A is the total area of the wire and the coefficient Q can be defined as:

$$Q=-\frac{I_1+I_2}{j\omega}$$

is the total charge of this wire cell element.

II. Rectangular Cell Element

As shown in FIG. 17*b*, the dimension of the rectangle is a by b and the current can be represented as:

$$J(r)=\sum_{i=1}^{4} I_iB_i(\xi,\eta) \tag{A-8}$$

where $$B_1(\xi,\eta)=\frac{\left(\xi+\frac{a}{2}\right)}{a\cdot b}\cdot\hat{\xi}\qquad B_3(\xi,\eta)=-\frac{\left(\frac{a}{2}-\xi\right)}{a\cdot b}\cdot\hat{\xi}$$

$$B_2(\xi,\eta)=\frac{\left(\eta+\frac{b}{2}\right)}{a\cdot b}\cdot\hat{\eta}\qquad B_4(\xi,\eta)=-\frac{\left(\frac{b}{2}-\eta\right)}{a\cdot b}\cdot\hat{\eta}$$

It can be noted that when an integration is performed over any side of the rectangle, e.g., $\Gamma_1$, for the basis function $B_1$, the following condition exists:

$$\int_{\Gamma_1} B_1(\xi,\eta)\cdot\hat{n}d\Gamma=\int_{-\frac{b}{2}}^{\frac{b}{2}}\frac{\left(\xi+\frac{a}{2}\right)}{a\cdot b}\Big[_{\xi=\frac{a}{2}}\hat{\xi}\cdot\hat{\xi}d\eta=1$$

as to the other sides of the rectangle, i.e., $\Gamma_1$ where i≠1, the coefficient for $I_i$ where i=1,2,3, and 4, in Equation A-8 is equivalent to the total current output from that side. Therefore, the total charge density corresponding to the total current can be obtained by:

$$\rho(\xi\cdot\eta)=Q\cdot\Pi(\xi,\eta)$$

where the base function for the total charge can be derived from:

$$\Pi(\xi,\eta)=\nabla_s\cdot B_i(\xi,\eta)=\frac{1}{ab}=\frac{1}{A}\ (i=1,2,3,4)$$

Similarly, A represents the total area of this cell and the total charge Q can be obtained as:

$$Q=-(1/j\omega)(I_1+I_2+I_3+I_4)$$

III. Triangle Cell Element

As shown in FIG. 17*c*, the three points defining the triangle are located at $r_1$, $r_2$ and $r_3$ whereas three sides are $\Gamma_1$, $\Gamma_2$, and $\Gamma_3$. The current inside the triangle can be represented as:

$$J(r)=\sum_{i=1}^{3} I_i\cdot B_i(r) \tag{A-9}$$

where $$B_i(r)=(r-r_i)/2A \text{ where } i=1,2,3$$

and A is the area of this triangle. The integration performed over each side is:

$$\int_{\Gamma_j} B_i(r)\cdot\hat{n}d\Gamma_j-\delta_{ij}$$

thus the coefficients Ii in Equation (A-9) represent the total current output from each side $\Gamma_i$ of the triangle, and the charge density is:

$$\rho(r)=Q\cdot\Pi(r)$$

where $$\Pi(r)=\nabla s\cdot B_i(r)-1/A\ (i=1,2,3)$$

and the total charge Q in the triangle cell is:

$$Q=-(1/j\omega)\ (I_1+I_2+I_3)$$

IV. Current Connection Matrix

As the antenna includes many different types of cell elements, assuming that the term $B_{Pi}(r)$ is a vector basis representing the current on a boundary line $\Gamma_{Pi}$ of a cell element $\Omega_p$ and $I_{Pi}$ representing the total current flow on that boundary line $\Gamma_{Pi}$ of that cell element $\Omega_p$. This current will flow into a boundary line of a next cell, e.g., q-th cell, thus, $I_{pi}=-I_{qj}$. A branch current can be defined as $\tilde{I}_n=I_{pi}=-I_{qj}$. The basis function $\tilde{B}_n(r)$ can therefore be represented as functions of $B_{Pi}(r)$ and $-B_{qj}(r)$:

$$J(r)=\sum_{n=1}^{N}\tilde{I}_n\tilde{B}_n(r)=\sum_{n=1}^{N}\tilde{I}_n\sum_{pi}T_{np_i}B_{p_i}(r) \tag{A-10}$$

where N is the number of total branches and [T] is a current branch matrix consisting of matrix elements $T_{npi}=1$ if the n-th branch current flows out of the i-th side of the p-th cell, $T_{npi}=-1$ if the n-th branch current flows into the i-th side of the p-th cell, and $T_{npi}=0$ if other than the above two conditions.

V. Equations for Full wavelength Equivalent Circuit

Moment method is often used for solving Equation A-5. By substituting Equation A-1 into Equation A-5, a functional relationship can be represented as:

$$\int\tilde{B}_m(r)\cdot E_t^i(r)d\Omega-j\omega\int\tilde{B}_m(r)\cdot A(r)d\,\Omega-\int\tilde{B}_m(r)\cdot\nabla\Phi(r)d\Omega=Z_s\int\tilde{B}_m(r)\cdot J(r)d\Omega \tag{A-12}$$

The third term can be simplified by the divergence theorem as:

$$\int\tilde{B}_m(r)\cdot\nabla\Phi(r)d\Omega=\oint_\Gamma\Phi(r)\tilde{B}_m(r)\cdot\hat{n}d\Gamma-\int\Phi r)\nabla_s\cdot\tilde{B}_m(r)d\Omega \tag{A-13}$$

On a boundary line Γ, the basis function for a cell element has the characteristic that $\tilde{n}\cdot\tilde{B}_m(r)$ has a value of zero. The line integration portion can be neglected. The magnetic vector potential A(r) and the electric scalar potential Φ(r) in the above equation can be represented as function of J(r) by the use of Equations (A-2) to (A-4). And the current function J(r) can be further expressed as function of the basis functions of each cell.

$$\tilde{V}_m=\sum_n\left\{\sum_{pi}\sum_{qj}T_{mq_j}\left(j\omega L_{q_jp_i}+\frac{1}{j\omega C_{qp}}+R_{q_jp_i}\right)T_{np_i}\right\}\tilde{I}_n \tag{A-14}$$

where $$L_{q_jp_i}=\int_{\Omega_q}d\Omega\int_{\Omega_q}d\Omega'\frac{\mu_0e^{-jkR}}{4\pi R}B_{q_j}(r)\cdot B_{p_i}(r')$$

$$\frac{1}{C_{qp}}=\int_{\Omega_q}d\Omega\int_{\Omega_p}d\Omega'\frac{e^{-jkR}}{4\pi\epsilon_0R}\Pi_q(r)\Pi_p(r')$$

$$R_{q_jp_i}=\delta_{pq}Z_s\int_{\Omega_p}d\Omega B_{q_j}(r)\cdot B_{p_i}(r)$$

and $$\tilde{V}_m=\int_\Omega\tilde{B}_m(r)\cdot E_t^i(r)d\Omega$$

representing an input voltage. In Equation A-14, when the frequency is low $e^{-jkR}\approx1$, where $L_{qi,pi}$ is a partial inductance between the bases $B_{qj}(r)$ and $B_{pi}(r)$ and $C_{qp}$ represents a partial capacitance between the q-th and p-th cells. As the frequency increases, the phase retarded term $e^{-jkR}$ can not be neglected where the inductance and the capacitance are all complex numbers and may be termed as the full wavelength inductance and capacitance.

The analyses can be carried out by including these equivalent components. FIG. **18*b*** is a diagram showing such an equivalent circuit. By the use of the KVL method, and assuming that a branch current is flowing from a m-th branch on a $J^+$ side of a $q^+$-th cell into $j^-$ side of a $q^-$ cell branch while the current on an n-th branch is from a $i^+$ side of a $p^+$ cell flowing into a i- side of a p- cell, then in a m-th loop:

$$\tilde{V}_m=\sum_n\tilde{Z}_{mn}\tilde{I}_n \tag{A-15}$$

where $$\tilde{Z}_{mn}=j\omega(L_{q_j^+p_i^+}+L_{q_j^-p_i^-}-L_{q_j^+p_i^-}-L_{q_j^-p_i^+})+\frac{1}{j\omega}\left(\frac{1}{C_{q^+p^+}}+\frac{1}{C_{q^-p^-}}-\frac{1}{C_{q^+p^-}}-\frac{1}{C_{q^-p^+}}\right)+(R_{q_j^+p_i^+}+R_{q_j^-p_i^-}-R_{q_j^+p_i^-}-R_{q_j^-p_i^+})$$

which is consistent with Equation A-14.

Please refer to FIG. **18*a*** for an input voltage source added to a m-th branch, the potential $\tilde{V}_m$ is imposed on a gap with width of Δ where the electric field is about:

$$E_t^i(s)=\frac{\tilde{V}_m}{\Delta}\tilde{n} \tag{A-16}$$

The first term in Equation A-12 can be defined as:

$$\int\tilde{B}_m(r)\cdot E_t^i(r)d\Omega=\Delta\cdot\int_\Gamma\tilde{n}\cdot\tilde{B}_m(r)\frac{\tilde{V}_m}{\Delta}d\Gamma=\tilde{V}_m \tag{A-17}$$

Which is consistent with the results obtained above. For the purposes of solving Equations A-14 and A-15, other than an input point, the input voltage, $\tilde{V}_m$, should be maintained at a zero value.

VI. Input Impedance and Radiation Pattern

When the branch currents are solved with appropriate input voltages in different branches, the impedance with respect to the antenna input is:

$$Z_{in}=\tilde{V}_m/\tilde{I}_m \tag{A-18}$$

Meanwhile, the electric field at any point r in the space can be obtained by the use of Equations A-1 to A-3, and when it is remote from the current source, $|r|=r\rightarrow\infty$ $$R=|r-r'|\cong r-\hat{r}\cdot r'$$

and the radiation pattern can be obtained by:

$$E^s(r)\cong\frac{j\omega\mu_0}{4\pi r}e^{-jkr}\int_\Omega e^{jk\hat{r}\cdot r'}\hat{r}\times(\hat{r}\times J(r'))d\Omega' \tag{A-19}$$

We claim:

1. A horizontal-U shaped antenna provided for application with a signal transmitting and receiving device, said antenna comprising:

a conductive base plate including two vertically side plates extending upwardly from one edge of said base plate;

two horizontal conductive antenna arms of unequal lengths each connected to a corresponding side plate extending horizontally over said base plate; and said conductive base plate is further provided to be electrically insulated from said signal transmitting and receiving device whereby a plurality of resonance currents are induced in said conductive base plate, said vertical side plates and said horizontal conductive antenna arms to generate a plurality of antenna resonant frequencies.

2. The antenna of claim 1 wherein:

said two horizontal conductive antenna arms of unequal lengths and said two corresponding side plates connected thereto further are separated by an opening slot.

3. The antenna of claim 2 wherein:

said opening slot further being tapered having a narrower opening near said plates and having an opening which being gradually widened therefrom.

4. The antenna of claim 1 further comprising:

a containing box for containing said signal transmitting and receiving device therein;

said containing box further including an upper cover; and said base plate being securely attached to and electrically insulated from said upper cover of said containing box.

5. A horizontal-U shaped antenna provided for application with a signal transmitting and receiving device, said antenna comprising:

a conductive base plate including two vertically side plates extending upwardly from one edge of said base plate;

two horizontal conductive antenna arms of unequal lengths each connected to a corresponding side plate extending horizontally over said base plate;

said two horizontal conductive antenna arms of unequal lengths and said two corresponding side plates connected thereto further are separated by an opening slot;

said opening slot further being tapered having a narrower opening near said plates and having an opening which being gradually widened therefrom;

a containing box for containing said signal transmitting and receiving device therein;

said containing box further including an upper cover; and said base plate being securely attached to and electrically insulated from said upper cover of said containing box and being electrically insulated from said signal transmitting and receiving device whereby a plurality of resonance currents are induced in said conductive base plate, said vertical side plates and said horizontal conductive antenna arms to generate a plurality of antenna resonant frequencies.

6. A method of generating multiple-resonance modes of operation in a horizontal-U shaped antenna including a conductive base plate of length L6 having two vertically side plates extending upwardly from one edge of said base plate and two horizontal conductive antenna arms of unequal lengths L1 and L2 respectively each connected to a corresponding side plate and extending horizontally over said base plate, said method including a step of:

(a) providing an insulation means to said horizontal-U shaped antenna for substantially insulating said antenna from external interference; and (b) adjusting the lengths of said L1, L2 and L6 whereby L1+L2 and L1+L6 are both approximately half of the wavelength $\lambda$ corresponding to a main resonance frequency.

7. A method of generating multiple-resonance mode of operation in a horizontal-U shaped antenna comprising the steps of:

(a) forming a base plate having multiple vertically side plates extending upwardly from one edge of said base plate;

(b) forming multiple horizontal conductive antenna arms corresponding to each of said vertical side plates each being of unequal length and being connected to said corresponding side plate and extending horizontally over said base plate; and (c) adjusting the lengths of said base plates and each of said horizontal antenna arms for achieving said multiple-resonance mode of operation; and (d) providing an insulation means to said horizontal-U shaped antenna for substantially insulating said base plate from a ground potential whereby a plurality of resonance currents may be induced in said base plate, said vertical side plates and said horizontal conductive antenna arms to generate a plurality of antenna resonant frequencies.

8. A method of designing a multiple-resonance horizontal-U shaped antenna for application with a signal transmitting and receiving device, wherein said antenna including a base plate having multiple vertically side plates extending upwardly from one edge of said base plate and multiple horizontal conductive antenna arms corresponding to each of said vertical side plates each being of unequal length and being connected to said corresponding side plate and extending horizontally over said base plate wherein said base plate is provided to be electrically insulated from said signal transmitting and receiving device, the method comprising the steps of:

(a) making a preliminary selection of a plurality of geometrical parameters of said antenna;

(b) performing a full wavelength equivalent circuit analysis with said geometrical parameters for said antenna for obtaining several performance variables;

(c) comparing said performance variables with a set of targeted performance variables; and (d) adjusting the lengths of said base plates and each of said horizontal antenna arms for achieving an optimal design wherein said performance variables being most approximating to said target performance variables.

* * * * *